US010818207B2

(12) United States Patent
Li et al.

(10) Patent No.: US 10,818,207 B2
(45) Date of Patent: Oct. 27, 2020

(54) CIRCUITRY AND METHOD FOR DETECTING FAILED PIXEL AND DISPLAY DEVICE

(71) Applicant: BOE TECHNOLOGY GROUP CO., LTD., Beijing (CN)

(72) Inventors: Yongqian Li, Beijing (CN); Pan Xu, Beijing (CN); Quanhu Li, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 119 days.

(21) Appl. No.: 16/086,675

(22) PCT Filed: Mar. 2, 2018

(86) PCT No.: PCT/CN2018/077884
§ 371 (c)(1),
(2) Date: Sep. 20, 2018

(87) PCT Pub. No.: WO2018/177072
PCT Pub. Date: Oct. 4, 2018

(65) Prior Publication Data

US 2020/0152101 A1 May 14, 2020

(30) Foreign Application Priority Data

Mar. 31, 2017 (CN) ..... 2017 1 0206482

(51) Int. Cl.
*G09G 3/00* (2006.01)
*G09G 3/30* (2006.01)

(52) U.S. Cl.
CPC ..... *G09G 3/006* (2013.01); *G09G 3/30* (2013.01); *G09G 2300/0842* (2013.01); *G09G 2320/029* (2013.01)

(58) Field of Classification Search
CPC ..... G09G 3/006
See application file for complete search history.

(56) References Cited

U.S. PATENT DOCUMENTS

2005/0200574 A1 9/2005 Goto et al.
2005/0212730 A1 9/2005 Sato et al.
(Continued)

FOREIGN PATENT DOCUMENTS

CN 1667682 A 9/2005
CN 1674075 A 9/2005
(Continued)

OTHER PUBLICATIONS

Written Opinion of the International Searching Authority for International Application No. PCT/CN2018/077884, dated Apr. 19, 2018.
(Continued)

*Primary Examiner* — Gustavo Polo
(74) *Attorney, Agent, or Firm* — Brooks Kushman P.C.

(57) ABSTRACT

A circuitry and a method for detecting a failed pixel, and a display device are provided. The circuitry for detecting the failed pixel includes a display control circuit and a failed pixel detection circuit. The display control circuit is connected to a pixel driving circuit, and configured to control, at detection voltage write-in stage and failed pixel detection stage, the pixel driving circuit to cause light-emitting element not to emit light. The failed pixel detection circuit is connected to first electrode of the light-emitting element via failure sense line, and configured to apply a reference voltage to the first electrode of the light-emitting element via the failure sense line at the detection voltage write-in stage, detect a potential at the first electrode of the light-emitting element at the failed pixel detection stage, and determine, in accordance with the potential, whether the pixel circuit is failed.

19 Claims, 3 Drawing Sheets

(56) References Cited

U.S. PATENT DOCUMENTS

| | | | | |
|---|---|---|---|---|
| 2006/0006794 | A1 | 1/2006 | Sakakura et al. | |
| 2007/0138956 | A1* | 6/2007 | Lee | G09G 3/32 313/512 |
| 2008/0218451 | A1 | 9/2008 | Miyamoto et al. | |
| 2012/0074856 | A1* | 3/2012 | Takata | H05B 45/37 315/192 |
| 2018/0033373 | A1 | 2/2018 | Hong et al. | |

FOREIGN PATENT DOCUMENTS

| | | | |
|---|---|---|---|
| CN | 1719311 | A | 1/2006 |
| CN | 101261803 | A | 9/2008 |
| CN | 106683605 | A | 5/2017 |
| CN | 107665663 | A | 2/2018 |
| JP | 2006145971 | A | 6/2006 |
| KR | 1020060113000 | A | 11/2006 |

OTHER PUBLICATIONS

Second Office Action for Chinese Application No. 201710206482.X, dated Aug. 16, 2019, 9 pages.

* cited by examiner

CIRCUITRY AND METHOD FOR DETECTING FAILED PIXEL AND DISPLAY DEVICE

CROSS-REFERENCE TO RELATED APPLICATIONS

This application is the U.S. national phase of PCT Application No. PCT/CN2018/077884 filed on Mar. 2, 2018, which claims priority to Chinese Patent Application No. 201710206482.X filed on Mar. 31, 2017, which are incorporated herein by reference in their entireties.

TECHNICAL FIELD

The present disclosure relates to a circuitry and a method for detecting a failed pixel, and a display device.

BACKGROUND

During the manufacture of a display device, a short circuit may occur between a cathode and an anode of a light-emitting element in a pixel due to some unavoidable factors such as particles (for example, dust). In a case of occurrence of such a bad pixel, a continuous supply of current to the short circuit results in an increasing current in the short circuit. At this time, due to a thermal effect, thin film transistors (TFT) and light-emitting elements of adjacent pixels may be aged rapidly, and even large area of bad pixels may occur.

SUMMARY

The present disclosure provides in some embodiments a circuitry for detecting a failed pixel, applied to a pixel circuit. The pixel circuit includes a light-emitting element and a pixel driving circuit connected to a first electrode of the light-emitting element. The circuitry for detecting the failed pixel includes a display control circuit and a failed pixel detection circuit. The display control circuit is connected to the pixel driving circuit and configured to control, at a detection voltage write-in stage and a failed pixel detection stage, the pixel driving circuit to cause the light-emitting element not to emit light. The failed pixel detection circuit is connected to the first electrode of the light-emitting element via a failure sense line, and configured to apply a reference voltage to the first electrode of the light-emitting element via the failure sense line at the detection voltage write-in stage, detect a potential at the first electrode of the light-emitting element at the failed pixel detection stage, and determine, in accordance with the potential, whether the pixel circuit is failed.

Optionally, in a possible embodiment of the present disclosure, the circuitry for detecting the failed pixel further includes a detection switch circuit and a switch control circuit. A control end of the detection switch circuit is connected to the switch control circuit, a first end of the detection switch circuit is connected to the first electrode of the light-emitting element, and a second end of the detection switch circuit is connected to the failure sense line. The switch control circuit is configured to control, at the detection voltage write-in stage and the failed pixel detection stage, the detection switch circuit to enable the first electrode of the light-emitting element to be connected to the failure sense line, and control, at a display stage, the detection switch circuit to enable the first electrode of the light-emitting element to be electrically disconnected from the failure sense line.

Optionally, the detection switch circuit includes a detection switch transistor, a gate electrode of which is connected to the switch control circuit, a first electrode of which is connected to the first electrode of the light-emitting element, and a second electrode of which is connected to the failure sense line.

Optionally, the pixel driving circuit is further connected to a data line. The failed pixel detection circuit is further connected to the display control circuit, and configured to output, after it is determined that the pixel circuit is failed, a dark-state control signal to the display control circuit. The display control circuit is connected to the data line, and configured to apply, upon receipt of the dark-state control signal, a dark-state data voltage to the data line at the display stage, so as to cause the light-emitting element not to emit light.

Optionally, the pixel driving circuit includes a driving transistor, a storage circuit and a data write-in circuit. A gate electrode of the driving transistor is connected to the data line via the data write-in circuit, a first electrode of the driving transistor is connected to a high level input end, a second electrode of the driving transistor is connected to the first electrode of the light-emitting element, and a second electrode of the light-emitting element is connected to a low level input end. The storage circuit is connected between the gate electrode of the driving transistor and the second electrode of the driving transistor. The display control circuit is further connected to the data write-in circuit, and configured to control, at the detection voltage write-in stage and the failed pixel detection stage, the data write-in circuit to enable the gate electrode of the driving transistor to be connected to the data line, and apply, at the detection voltage write-in stage and the failed pixel detection stage, an off-state voltage to the data line so as to turn off the driving transistor.

Optionally, the storage circuit includes a storage capacitor.

Optionally, the data write-in circuit includes a data write-in transistor, a gate electrode of the data write-in transistor is connected to the display control circuit, a source electrode of the data write-in transistor is connected to a source electrode of the driving transistor, and a drain electrode of the data write-in transistor is connected to the data line.

Optionally, the light-emitting element is a self-luminescence element.

Optionally, the first electrode of the light-emitting element is an anode, the second electrode of the light-emitting element is a cathode, and a voltage value of the reference voltage is greater than a voltage value applied to the cathode of the light-emitting element.

Optionally, the failed pixel detection circuit is further configured to determine, at the failed pixel detection stage, that the pixel circuit is failed, in response to detecting that the potential at the first electrode of the light-emitting element is smaller than a preset voltage value.

The present disclosure further provides in some embodiments a method for detecting a failed pixel, applied to the above-mentioned circuitry for detecting the failed pixel, including: at the detection voltage write-in stage, controlling, by the display control circuit, the pixel driving circuit to cause the light-emitting element not to emit light, and applying, by the failed pixel detection circuit, the reference voltage to the first electrode of the light-emitting element via the failure sense line; and at the failed pixel detection stage, controlling, by the display control circuit, the pixel driving circuit to cause the light-emitting element not to emit light, detecting, by the failed pixel detection circuit, the potential at the first electrode of the light-emitting element, and determining, in accordance with the potential, whether the pixel circuit is failed.

Optionally, the circuitry for detecting the failed pixel further includes a detection switch circuit and a switch control circuit. The failed pixel defection method further includes: controlling, at the detection voltage write-in stage and the failed pixel detection stage, by the switch control circuit, the detection switch circuit to enable the first electrode of the light-emitting element to be connected to the failure sense line; and controlling, at a display stage, by the switch control circuit, the detection switch circuit to enable the first electrode of the light-emitting element to be disconnected from the failure sense line.

Optionally, the method for detecting the failed pixel further includes: outputting, after the failed pixel detection circuit has determined that the pixel circuit is failed, by the failed pixel detection circuit, a dark-state control signal to the display control circuit; and applying, upon receipt of the dark-state control signal, by the display control circuit, a dark-state data voltage to the data line at the display stage, so as to cause the light-emitting element not to emit light.

Optionally, the first electrode of the light-emitting element is an anode, a second electrode of the light-emitting element is a cathode, and a voltage value of the reference voltage is greater than a voltage value applied to the cathode of the light-emitting element.

Optionally, detecting, by the failed pixel detection circuit, the potential at the first electrode of the light-emitting element and determining, in accordance with the potential, whether the pixel circuit is failed includes: determining, in response to detecting that the potential at the first electrode of the light-emitting element is smaller than a preset voltage value, by the failed pixel detection circuit, that the pixel circuit is failed.

The present disclosure further provides in some embodiments a display device including a pixel circuit and the above-mentioned circuitry for detecting the failed pixel. The circuitry for detecting the failed pixel is connected to the pixel circuit and configured to detect whether the pixel circuit is failed.

DETAILED DESCRIPTION

Technical solutions in embodiments of the present disclosure will be described hereinafter in a clear and complete manner in conjunction with the drawings of the embodiments of the present disclosure. Apparently, the embodiments described herein are only a few rather than all of the embodiments of the present disclosure. All other embodiments obtained based on the embodiments of the present disclosure by those skilled in the art without any creative efforts fall within the protection scope of the present disclosure.

Transistors adopted in the embodiments of the present disclosure each may be a thin film transistor, a field effect transistor, or any other element having a same feature.

Figure 1:
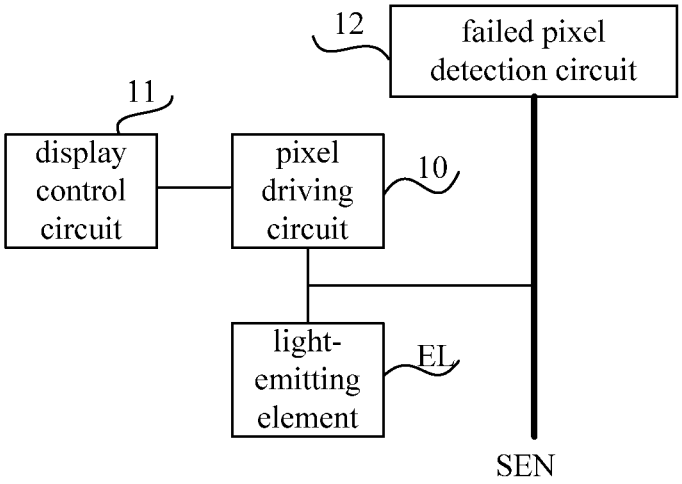
FIG. 1 is a schematic view of a circuitry for detecting a failed pixel according to an embodiment of the present disclosure.

The present disclosure provides in some embodiments a circuitry for detecting a failed pixel, which is connected to a pixel circuit. As shown in FIG. 1, the pixel circuit includes a light-emitting element EL and a pixel driving circuit 10 connected to each other. For example, the pixel driving circuit 10 may be connected to a first electrode of the light-emitting element EL.

The circuitry for detecting the failed pixel according to the embodiments of the present disclosure includes a display control circuit 11 and a failed pixel detection circuit 12.

The display control circuit 11 is connected to the pixel driving circuit 10, and configured to control, at a detection voltage write-in stage and a failed pixel detection stage, the pixel driving circuit 10 to cause the light-emitting element not to emit light.

The failed pixel detection circuit 12 is connected to the first electrode of the light-emitting element via a failure sense line SEN, and configured to apply a reference voltage to the first electrode of the light-emitting element via the failure sense line SEN at the detection voltage write-in stage, detect a potential at the first electrode of the light-emitting element at the failed pixel detection stage, and determine, in accordance with the potential, whether the pixel circuit is failed.

According to the embodiments of the present disclosure, the circuitry for detecting the failed pixel includes the display control circuit 11 and the failed pixel detection circuit 12. The display control circuit 11 controls, at the detection voltage write-in stage and the failed pixel detection stage, the light-emitting element EL not to emit light. The failed pixel detection circuit 12 applies, at the detection voltage write-in stage, the reference voltage to the first electrode of the light-emitting element via the failure sense line SEN. At the failed pixel detection stage, it is determined, in accordance with the potential at the first electrode of the light-emitting element, whether the potential at the first electrode of the light-emitting element cannot be maintained as a path between the first electrode of the light-emitting element and a second electrode of the light-emitting element is turned on due to a failed pixel. As a result, it is able to determine, in accordance with the potential at the first electrode of the light-emitting element, whether the pixel circuit is failed.

The circuitry for detecting the failed pixel in the embodiments of the present disclosure may be configured to detect a failed pixel due to a short circuit of the light-emitting element. In actual use, as the second electrode of the light-emitting element is usually grounded or connected to a low level, when a path between the first electrode of the light-emitting element and the second electrode of the light-emitting element is turned on, the potential at the first electrode of the light-emitting element detected by the failed pixel detection circuit 12 at the failed pixel detection stage is relatively low. When an abnormality degree of the potential at the first electrode of the light-emitting element exceeds a preset value, the corresponding pixel may be marked as a failed pixel, and then position information about the pixel may be stored.

Optionally, the light-emitting element may be any self-luminescence element capable of being aged due to a current impact, such as an organic light-emitting diode (OLED), quantum dot light-emitting diode (QD-LED) or micro-LED. The first electrode of the light-emitting element may be an anode, and the second electrode thereof may be a cathode.

In some possible embodiments of the present disclosure, the failed pixel may be detected each time when a display device is turned off and has a black screen, rather than being detected when the display device is in a normal display state, so as to prevent a normal display effect from being affected.

Figure 2:
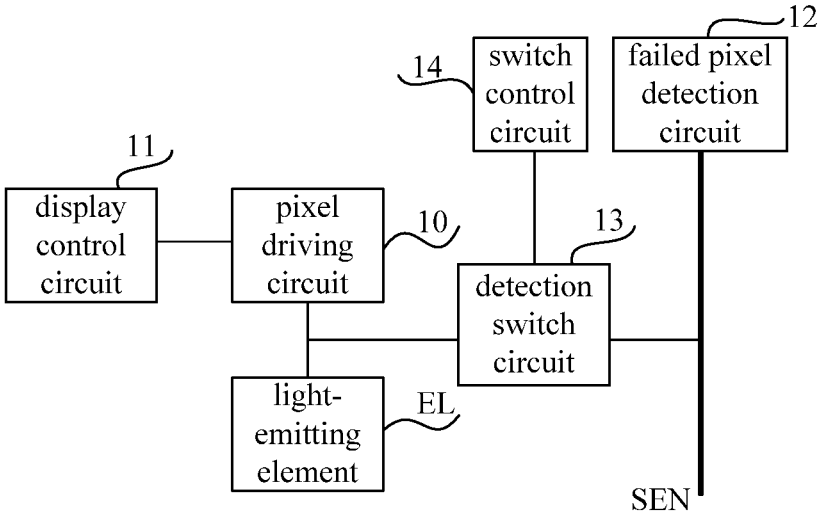
FIG. 2 is another schematic view of a circuitry for detecting a failed pixel according to an embodiment of the present disclosure.

In some possible embodiments of the present disclosure, as shown in FIG. 2, the circuitry for detecting the failed pixel further includes a detection switch circuit 13 and a switch control circuit 14.

A control end of the detection switch circuit 13 is connected to the switch control circuit 14. A first end of the detection switch circuit 13 is connected to the first electrode of the light-emitting element EL. A second end of the detection switch circuit 13 is connected to the failure sense line SEN.

The switch control circuit 14 is configured to control, at the detection voltage write-in stage and the failed pixel detection stage, the detection switch circuit 13 to enable the first electrode of the light-emitting element EL to be electrically connected to the failure sense line SEN, and control at a display stage, the detection switch circuit 13 to cause the first electrode of the light-emitting element EL not to be connected to (for example, being electrically disconnected from) the failure sense line SEN.

In the embodiment of the present disclosure as shown in FIG. 2, the circuitry for detecting the failed pixel further includes the detection switch circuit 13 and the switch control circuit 14. At the detection voltage write-in stage and the failed pixel detection stage, the switch control circuit 14 controls the detection switch circuit 13 to enable the first electrode of the light-emitting element EL to be electrically connected to the failure sense line SEN, and at the display stage, controls the detection switch circuit 13 to cause the first electrode of the light-emitting element EL not to be electrically connected to the failure sense line SEN, so as to prevent a normal display effect from being affected.

In some possible embodiments of the present disclosure, the detection switch circuit includes a detection switch transistor, a gate electrode of which is connected to the switch control circuit, a first electrode of which is connected to the first electrode of the light-emitting element, and a second electrode of which is connected to the failure sense line.

Figure 3:
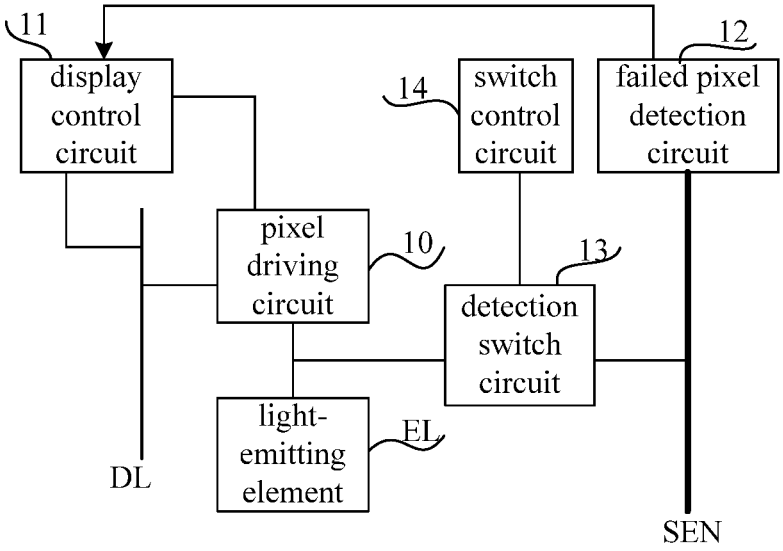
FIG. 3 is yet another schematic view of a circuitry for detecting a failed pixel according to an embodiment of the present disclosure.

In some possible embodiments of the present disclosure, as shown in FIG. 3, the pixel driving circuit 10 is further connected the a data line DL and configured to control, in accordance with a data voltage across the data line DL, whether to cause the light-emitting element EL to emit light.

The failed pixel detection circuit 12 is further connected to the display control circuit 11, and configured to output, after it is determined that the pixel circuit is failed, a dark-state control signal to the display control circuit 11 at the display stage. The display control circuit 11 is connected to the data line DL, and configured to apply, upon receipt of the dark-state control signal, a dark-state data voltage to the data line DL at the display stage, so as to cause the light-emitting element EL not to emit light.

In the embodiments of the present disclosure, when the failed pixel detection circuit 12 has determined that the pixel circuit is failed, the failed pixel detection circuit 12 may control the display control circuit 11 to cause the light-emitting element of the failed pixel not to emit light at the display stage. As a result, a situation where a continuous supply of current to a short circuit resulting from a bad pixel leads to an increasing current in the short circuit is prevented. And then occurrence of large area of failed pixels, which are caused by the fact that thin film transistors (TFT) and light-emitting elements of adjacent pixels may be aged rapidly due to a thermal effect, is prevented.

Figure 4:
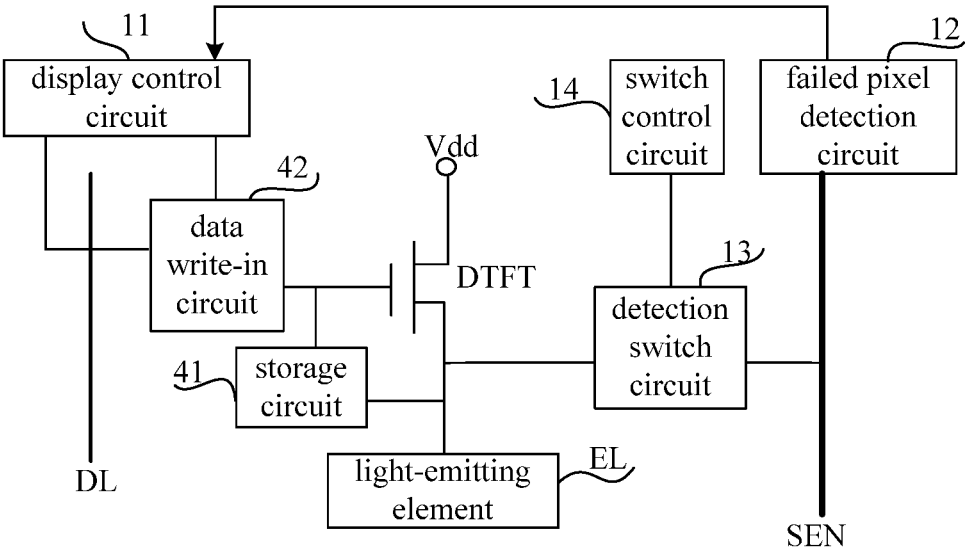
FIG. 4 is still yet another schematic view of a circuitry for detecting a failed pixel according to an embodiment of the present disclosure.

In some possible embodiments of the present disclosure, as shown in FIG. 4, the pixel driving circuit may include a driving transistor DTFT, a storage circuit 41 and a data write-in circuit 42.

A gate electrode of the driving transistor DTFT is connected to the data line DL via the data write-in circuit 42. A first electrode of the driving transistor DTFT is connected to a high level input end Vdd. A second electrode of the driving transistor DTFT is connected to the first electrode of the light-emitting element EL. A second electrode of the light-emitting element EL is connected to a low level input end VSS.

The storage circuit 41 is connected between the gate electrode of the driving transistor DTFT and the second electrode of the driving transistor DTFT.

Optionally, the storage circuit 41 includes a storage capacitor, a first end of which is connected to the gate electrode of the driving transistor, and a second end of which is connected to the second electrode of the driving transistor.

The display control circuit 11 is connected to the data line DL and the data write-in circuit 42, and configured to control, at the detection voltage write-in stage and the failed pixel detection stage, the data write-in circuit 42 to enable the gate electrode of the driving transistor DTFT to be electrically connected to the data line DL, and apply, at the detection voltage write-in stage and the failed pixel detection stage, an off-state voltage to the data line DL so as to turn off the driving transistor DTFT.

In some possible embodiments of the present disclosure, the storage circuit 41 may include a storage capacitor. In FIG. 4, a case where the driving transistor DTFT is an n-type transistor is taken as an example, and at this time, the first electrode of the DTFT is a drain electrode of the DTFT, and the second electrode of the DTFT is a source electrode of the DTFT. Practically, the DTFT may also be a p-type transistor.

Figure 5:
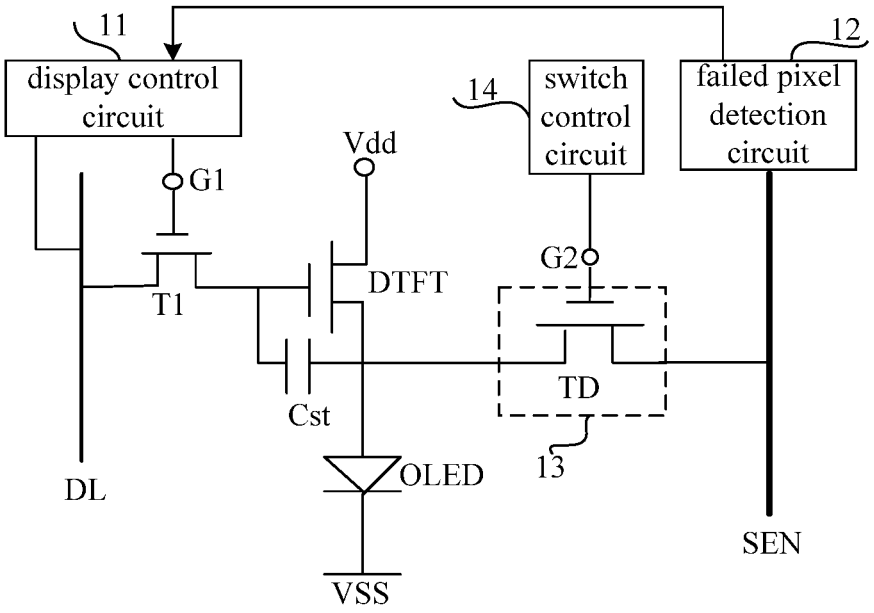
FIG. 5 is a circuit diagram of a circuitry for detecting a failed pixel according to an embodiment of the present disclosure.

In some possible embodiments of the present disclosure, the circuitry for detecting the failed pixel is connected to the pixel circuit. As shown in FIG. 5, the pixel circuit includes the organic light-emitting diode OLED and the pixel driving circuit connected to each other. The pixel driving circuit is connected to an anode of the OLED. The circuitry for detecting the failed pixel according to the present disclosure includes the display control circuit 11, the failed pixel detection circuit 12, the detection switch circuit 13 and the switch control circuit 14.

The detection switch circuit 13 includes a detection switch transistor TD, a gate electrode of which is connected to the switch control circuit 14 via a switch control end G2, a source electrode of which is connected to the anode of the OLED, and a drain electrode of which is connected to the failure sense line SEN.

The switch control circuit 14 is configured to control the detection switch transistor TD to be turned on at the detection voltage write-in stage and the failed pixel detection stage so as to enable the anode of the OLED to be electrically connected to the failure sense line SEN, and control the detection switch transistor TD to be turned off at the display stage so as to enable the anode of the OLED not to be electrically connected to the failure sense line SEN.

The pixel driving circuit includes a driving transistor DTFT, a storage capacitor Cst and a data write-in transistor T1.

A gate electrode of the driving transistor DTFT is connected to a source electrode of the data write-in transistor T1. A drain electrode of the driving transistor DTFT is connected to the high level input end Vdd. A source electrode of the driving transistor DTFT is connected to the anode of the OLED.

A gate electrode of the data write-in transistor T1 is connected to a scanning line G1. A drain electrode of the data write-in transistor T1 is connected to the data line DL.

The storage capacitor Cst is connected between the gate electrode of the driving transistor DTFT and the source electrode of the driving transistor DTFT.

The cathode of the OLED is connected to the low level input end VSS.

The display control circuit 11 is connected to the data line DL and the scanning line G1, and configured to control, at the detection voltage write-in stage and the failed pixel detection stage, the data write-in transistor T1 to be turned so as to enable the gate electrode of the driving transistor DTFT to be electrically connected to the data line DL, and apply, at the detection voltage write-in stage and the failed pixel detection stage, the off-stage voltage to the data line DL so as to turn off the driving transistor DTFT. The DTFT is an n-type transistor, so the off-state voltage may have a value of zero.

The failed pixel detection circuit 12 is connected to the drain electrode of the TD via the failure sense line SEN, and configured to apply, at the detection voltage write-in stage, the reference voltage Vref to the anode of the OLED via the failure sense line SEN and the turned-on TD, detect, at the failed pixel detection stage, the potential at the anode of the OLED, and determine, in accordance with the potential, whether the pixel circuit is failed.

The failed pixel detection circuit 12 is further connected to the display control circuit 11, and configured to output, when it is determined that the pixel circuit is failed, a dark-state control signal to the display control circuit 11.

The display control circuit 11 is connected to the data line DL, and configured to apply, upon receipt of the dark-state control signal, a dark-state data voltage to the data line DL at the display stage, so as to disable the OLED.

Optionally, C1 represents a parasitic capacitance on the failure sense line SEN. The failed pixel detection circuit 12 may be arranged in a driving integrated circuit (IC). The display control circuit 11 may also be arranged in the driving IC.

In some possible embodiments of the present disclosure, the failed pixel detection circuit 12 may include an analog-to-digital converter (ADC) (the analog-to-digital converter ADC is configured to detect the potential at the anode of the OLED so as to determine whether a pixel is failed), a switch and a reference voltage output end. At the detection voltage write-in stage, the switch controls the reference voltage output end to be electrically connected to the failure sense line SEN. At the failed pixel detection stage, the switch controls the analog-to-digital converter to be electrically connected to the failure sense line SEN, so as to detect the voltage across the failure sense line SEN via the analog-to-digital converter.

An operating procedure of the circuitry for detecting the failed pixel in FIG. 5 will be described hereinafter.

At the detection voltage write-in stage, the TD is turned on, and the failed pixel detection circuit 12 applies the reference voltage Vref to the SEN. The display control circuit 11 controls the T1 to be turned-on, so as to enable the gate electrode of DTFT to be electrically connected to the data line DL. Then, the display control circuit 11 applies the off-state voltage to the data line DL, so as to turn off the driving transistor DTFT, and apply the reference voltage Vref to the anode of the OLED without causing the OLED to emit light. Due to the parasitic capacitance C1 on the SEN, the reference voltage Vref is stored.

Optionally, a voltage value of the reference voltage Vref may be greater than a voltage value applied to the cathode of the OLED. For example, when a negative voltage is applied to the cathode of the OLED, the reference voltage Vref may have a value of 0V-4V, and when the cathode of the OLED is grounded, the reference voltage Vref may be a positive voltage.

At the failed pixel detection stage, the TD is turned on, and the failed pixel detection circuit 12 detects the voltage applied to the anode of the OLED via the SEN. When the pixel is a failed pixel, the anode and the cathode of the OLED may be short circuited. At this time, the SEN may be directly connected to the low level input end VSS. Or, when an abnormality degree of the voltage at the anode of the OLED detected by the failed pixel detection circuit 12 exceeds a preset value, the corresponding pixel may be marked as a failed pixel, and position information about the failed pixel may be stored in a memory.

At the display stage, the TD is turned off, so the anode of the OLED is not connected to the failure sense line SEN. A data voltage across the data line connected to the failed pixel as marked is controlled by the display control circuit 11 as 0V (at this time, the data voltage may also have any other value capable of turning off the DTFT), so as to turn off the DTFT and prevent a driving current of the driving transistor DTFT from flowing through the failed pixel, thereby preventing other pixels from being damaged.

Figure 6:
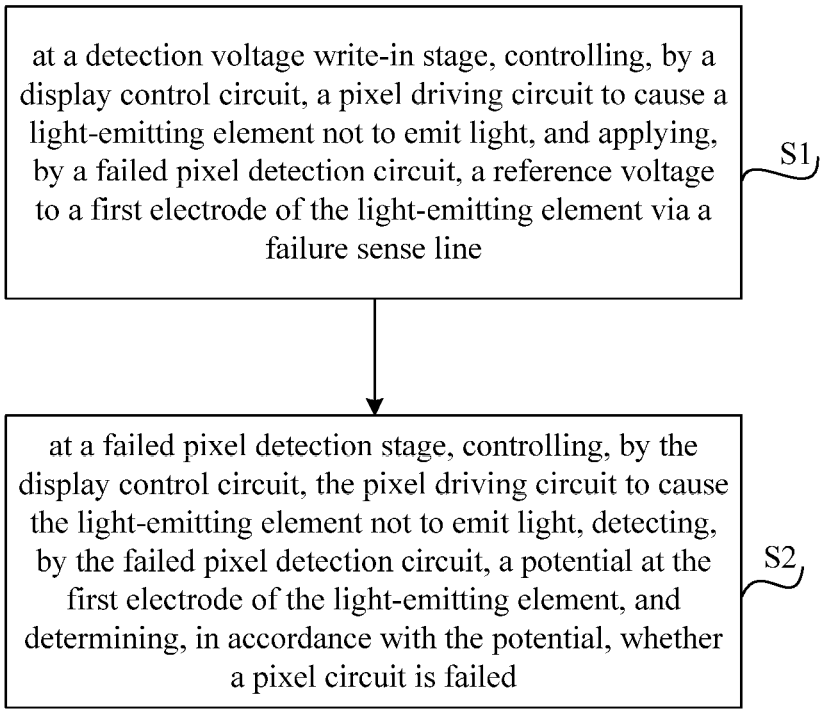
FIG. 6 is a flow chart of a circuitry for detecting a failed pixel according to an embodiment of the present disclosure.

The present disclosure further provides in some embodiments a method for detecting a failed pixel, applied to the above-mentioned circuitry for detecting the failed pixel. As shown in FIG. 6, the method for detecting the failed pixel includes steps S1 to S2.

In step S1, at the detection voltage write-in stage, the display control circuit controls the pixel driving circuit to cause the light-emitting element not to emit light, and the failed pixel detection circuit applies the reference voltage to the first electrode of the light-emitting element via the failure sense line.

In step S2, at the failed pixel detection stage, the display control circuit controls the pixel driving circuit to cause the light-emitting element not to emit light, and the failed pixel detection circuit detects the potential at the first electrode of the light-emitting element, and determines in accordance with the potential whether a pixel circuit is failed.

In some possible embodiments of the present disclosure, the circuitry for detecting the failed pixel further includes a detection switch circuit and a switch control circuit. The method for detecting the failed pixel further includes: at the detection voltage write-in stage and the failed pixel detection stage, controlling, by the switch control circuit, the detection switch circuit to enable the first electrode of the light-emitting element to be connected to the failure sense line; and at a display stage, controlling, by the switch control circuit, the detection switch circuit to cause the first electrode of the light-emitting element not to be connected to the failure sense line.

In some possible embodiments of the present disclosure, the method for detecting the failed pixel further includes: after the failed pixel detection circuit has determined that the pixel circuit is failed, outputting, by the failed pixel detection circuit, a dark-state control signal to the display control circuit; and upon receipt of the dark-state control signal, applying, by the display control circuit, a dark-state data voltage to the data line at the display stage, so as to cause the light-emitting element not to emit light.

The present disclosure further provides in some embodiments a display device, including a pixel circuit and the above-mentioned circuitry for detecting the failed pixel.

The circuitry for detecting the failed pixel is connected to the pixel circuit.

The above are merely some embodiments of the present disclosure. It should be noted that, a person skilled in the art may make modifications and improvements without departing from the principle of the present disclosure, and these modifications and improvements shall also fall within the scope of the present disclosure.

What is claimed is:

1. A circuitry for detecting a failed pixel, applied to a pixel circuit, wherein the pixel circuit comprises a light-emitting element and a pixel driving circuit connected to a first electrode of the light-emitting element;

the circuitry for detecting the failed pixel comprises a display control circuit and a failed pixel detection circuit;

the display control circuit is connected to the pixel driving circuit and configured to control, at a detection voltage write-in stage and a failed pixel detection stage, the pixel driving circuit to cause the light-emitting element not to emit light;

the failed pixel detection circuit is connected to the first electrode of the light-emitting element via a failure sense line, and configured to apply a reference voltage to the first electrode of the light-emitting element via the failure sense line at the detection voltage write-in stage, detect a potential at the first electrode of the light-emitting element at the failed pixel detection stage, and determine, in accordance with the potential, whether the pixel circuit is failed;

the pixel driving circuit is further connected to a data line;

the failed pixel detection circuit is further connected to the display control circuit, and configured to output, after it is determined that the pixel circuit is failed, a dark-state control signal to the display control circuit; and the display control circuit is connected to the data line, and configured to apply, upon receipt of the dark-state control signal, a dark-state data voltage to the data line at a display stage, so as to cause the light-emitting element not to emit light.

2. The circuitry for detecting the failed pixel according to claim 1, further comprising a detection switch circuit and a switch control circuit, wherein a control end of the detection switch circuit is connected to the switch control circuit, a first end of the detection switch circuit is connected to the first electrode of the light-emitting element, and a second end of the detection switch circuit is connected to the failure sense line; and the switch control circuit is configured to control, at the detection voltage write-in stage and the failed pixel detection stage, the detection switch circuit to enable the first electrode of the light-emitting element to be electrically connected to the failure sense line, and control, at a display stage, the detection switch circuit to enable the first electrode of the light-emitting element to be electrically disconnected from the failure sense line.

3. The circuitry for detecting the failed pixel according to claim 2, wherein the detection switch circuit comprises a detection switch transistor, a gate electrode of the detection switch transistor is connected to the switch control circuit, a first electrode of the detection switch transistor is connected to the first electrode of the light-emitting element, and a second electrode of the detection switch transistor is connected to the failure sense line.

4. The circuitry for detecting the failed pixel according to claim 1, wherein the pixel driving circuit comprises a driving transistor, a storage circuit and a data write-in circuit;

a gate electrode of the driving transistor is connected to the data line via the data write-in circuit, a first electrode of the driving transistor is connected to a high level input end, a second electrode of the driving transistor is connected to the first electrode of the light-emitting element, and a second electrode of the light-emitting element is connected to a low level input end;

the storage circuit is connected between the gate electrode of the driving transistor and the second electrode of the driving transistor; and the display control circuit is further connected to the data write-in circuit, and configured to control, at the detection voltage write-in stage and the failed pixel detection stage, the data write-in circuit to enable the gate electrode of the driving transistor to be electrically connected to the data line, and apply, at the detection voltage write-in stage and the failed pixel detection stage, an off-state voltage to the data line so as to turn off the driving transistor.

5. The circuitry for detecting the failed pixel according to claim 4, wherein the storage circuit comprises a storage capacitor.

6. The circuitry for detecting the failed pixel according to claim 4, wherein the data write-in circuit comprises a data write-in transistor, a gate electrode of the data write-in transistor is connected to the display control circuit, a source electrode of the data write-in transistor is connected to a source electrode of the driving transistor, and a drain electrode of the data write-in transistor is connected to the data line.

7. The circuitry for detecting the failed pixel according to claim 1, wherein the light-emitting element is a self-luminescence element.

8. The circuitry for detecting the failed pixel according to claim 1, wherein the first electrode of the light-emitting element is an anode, the second electrode of the light-emitting element is a cathode, and a voltage value of the reference voltage is greater than a voltage value applied to the cathode of the light-emitting element.

9. The circuitry for detecting the failed pixel according to claim 8, wherein the failed pixel detection circuit is further configured to determine, at the failed pixel detection stage, that the pixel circuit is failed, in response to detecting that the potential at the first electrode of the light-emitting element is smaller than a preset voltage value.

10. A method for detecting a failed pixel, applied to the circuitry for detecting the failed pixel according to claim 1, comprising:

at the detection voltage write-in stage, controlling, by the display control circuit, the pixel driving circuit to cause the light-emitting element not to emit light, and applying, by the failed pixel detection circuit, the reference voltage to the first electrode of the light-emitting element via the failure sense line; and at the failed pixel detection stage, controlling, by the display control circuit, the pixel driving circuit to cause the light-emitting element not to emit light, detecting, by the failed pixel detection circuit, the potential at the first electrode of the light-emitting element, and determining, in accordance with the potential, whether the pixel circuit is failed.

11. The method for detecting the failed pixel according to claim 10, wherein the circuitry for detecting the failed pixel further comprises a detection switch circuit and a switch control circuit, and wherein the failed pixel defection method further comprises:

controlling, at the detection voltage write-in stage and the failed pixel detection stage, by the switch control circuit, the detection switch circuit to enable the first electrode of the light-emitting element to be electrically connected to the failure sense line; and controlling, at a display stage, by the switch control circuit, the detection switch circuit to enable the first electrode of the light-emitting element to be electrically disconnected from the failure sense line.

12. The method for detecting the failed pixel according to claim 10, further comprising:

outputting, after the failed pixel detection circuit determines that the pixel circuit is failed, by the failed pixel detection circuit, a dark-state control signal to the display control circuit; and applying, upon receipt of the dark-state control signal, by the display control circuit, a dark-state data voltage to the data line at the display stage, so as to cause the light-emitting element not to emit light.

13. The method for detecting the failed pixel according to claim 10, wherein the first electrode of the light-emitting element is an anode, a second electrode of the light-emitting element is a cathode, and a voltage value of the reference voltage is greater than a voltage value applied to the cathode of the light-emitting element.

14. The method for detecting the failed pixel according to claim 13, wherein detecting, by the failed pixel detection circuit, the potential at the first electrode of the light-emitting element and determining, in accordance with the potential, whether the pixel circuit is failed comprises: determining, in response to detecting that the potential at the first electrode of the light-emitting element is smaller than a preset voltage value, by the failed pixel detection circuit, that the pixel circuit is failed.

15. A display device, comprising a pixel circuit and the circuitry for detecting the failed pixel according to claim 1, wherein the circuitry for detecting the failed pixel is connected to the pixel circuit and configured to detect whether the pixel circuit is failed.

16. The circuitry for detecting the failed pixel according to claim 5, wherein the data write-in circuit comprises a data write-in transistor, a gate electrode of the data write-in transistor is connected to the display control circuit, a source electrode of the data write-in transistor is connected to a source electrode of the driving transistor, and a drain electrode of the data write-in transistor is connected to the data line.

17. The method for detecting the failed pixel according to claim 11, further comprising:

outputting, after the failed pixel detection circuit determines that the pixel circuit is failed, by the failed pixel detection circuit, a dark-state control signal to the display control circuit; and applying, upon receipt of the dark-state control signal, by the display control circuit, a dark-state data voltage to the data line at the display stage, so as to cause the light-emitting element not to emit light.

18. A method for detecting a failed pixel, applied to a circuitry for detecting a failed pixel, wherein the circuitry for detecting the failed pixel is applied to a pixel circuit, the pixel circuit comprises a light-emitting element and a pixel driving circuit connected to a first electrode of the light-emitting element;

the circuitry for detecting the failed pixel comprises a display control circuit and a failed pixel detection circuit;

the display control circuit is connected to the pixel driving circuit and configured to control, at a detection voltage write-in stage and a failed pixel detection stage, the pixel driving circuit to cause the light-emitting element not to emit light; and the failed pixel detection circuit is connected to the first electrode of the light-emitting element via a failure sense line, and configured to apply a reference voltage to the first electrode of the light-emitting element via the failure sense line at the detection voltage write-in stage, detect a potential at the first electrode of the light-emitting element at the failed pixel detection stage, and determine, in accordance with the potential, whether the pixel circuit is failed;

the method comprises:

at the detection voltage write-in stage, controlling, by the display control circuit, the pixel driving circuit to cause the light-emitting element not to emit light, and applying, by the failed pixel detection circuit, the reference voltage to the first electrode of the light-emitting element via the failure sense line;

at the failed pixel detection stage, controlling, by the display control circuit, the pixel driving circuit to cause the light-emitting element not to emit light, detecting, by the failed pixel detection circuit, the potential at the first electrode of the light-emitting element, and determining, in accordance with the potential, whether the pixel circuit is failed;

outputting, after the failed pixel detection circuit determines that the pixel circuit is failed, by the failed pixel detection circuit, a dark-state control signal to the display control circuit; and applying, upon receipt of the dark-state control signal, by the display control circuit, a dark-state data voltage to the data line at the display stage, so as to cause the light-emitting element not to emit light.

19. A method for detecting a failed pixel, applied to a circuitry for detecting a failed pixel, wherein the circuitry for detecting the failed pixel is applied to a pixel circuit, the pixel circuit comprises a light-emitting element and a pixel driving circuit connected to a first electrode of the light-emitting element;

the circuitry for detecting the failed pixel comprises a display control circuit and a failed pixel detection circuit;

the display control circuit is connected to the pixel driving circuit and configured to control, at a detection voltage write-in stage and a failed pixel detection stage, the pixel driving circuit to cause the light-emitting element not to emit light; and the failed pixel detection circuit is connected to the first electrode of the light-emitting element via a failure sense line, and configured to apply a reference voltage to the first electrode of the light-emitting element via the failure sense line at the detection voltage write-in stage, detect a potential at the first electrode of the light-emitting element at the failed pixel detection stage, and determine, in accordance with the potential, whether the pixel circuit is failed;

the method comprises:

at the detection voltage write-in stage, controlling, by the display control circuit, the pixel driving circuit to cause the light-emitting element not to emit light, and applying, by the failed pixel detection circuit, the reference voltage to the first electrode of the light-emitting element via the failure sense line; and at the failed pixel detection stage, controlling, by the display control circuit, the pixel driving circuit to cause the light-emitting element not to emit light, detecting, by the failed pixel detection circuit, the potential at the first electrode of the light-emitting element, and determining, in accordance with the potential, whether the pixel circuit is failed;

wherein the circuitry for detecting the failed pixel further comprises a detection switch circuit and a switch control circuit, and wherein the method further comprises:

controlling, at the detection voltage write-in stage and the failed pixel detection stage, by the switch control circuit, the detection switch circuit to enable the first electrode of the light-emitting element to be electrically connected to the failure sense line;

controlling, at a display stage, by the switch control circuit, the detection switch circuit to enable the first electrode of the light-emitting element to be electrically disconnected from the failure sense line;

outputting, after the failed pixel detection circuit determines that the pixel circuit is failed, by the failed pixel detection circuit, a dark-state control signal to the display control circuit; and applying, upon receipt of the dark-state control signal, by the display control circuit, a dark-state data voltage to the data line at the display stage, so as to cause the light-emitting element not to emit light.

* * * * *